US011114004B2

(12) United States Patent
Li et al.

(10) Patent No.: US 11,114,004 B2
(45) Date of Patent: Sep. 7, 2021

(54) GATE DRIVING UNIT, DRIVING METHOD THEREOF, GATE DRIVING CIRCUIT AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Yan Li, Beijing (CN); Lingyun Shi, Beijing (CN); Wei Sun, Beijing (CN); Xiaobo Xie, Beijing (CN); Meiling Jin, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 513 days.

(21) Appl. No.: 16/094,615

(22) PCT Filed: Mar. 14, 2018

(86) PCT No.: PCT/CN2018/078958
§ 371 (c)(1),
(2) Date: Oct. 18, 2018

(87) PCT Pub. No.: WO2018/192326
PCT Pub. Date: Oct. 25, 2018

(65) Prior Publication Data

US 2021/0225227 A1 Jul. 22, 2021

(30) Foreign Application Priority Data

Apr. 21, 2017 (CN) ..... 201710264805.0

(51) Int. Cl.
*G09G 3/20* (2006.01)

(52) U.S. Cl.
CPC ..... *G09G 3/20* (2013.01); *G09G 2300/0426* (2013.01); *G09G 2300/08* (2013.01);
(Continued)

(58) Field of Classification Search
CPC ..... G09G 2300/0408; G09G 3/20; G09G 2310/0267; G09G 3/3266; G09G 3/3674;
(Continued)

(56) References Cited

U.S. PATENT DOCUMENTS

2011/0148853 A1 6/2011 Ko
2014/0160000 A1* 6/2014 Ma ..... G11C 19/28 345/100

(Continued)

FOREIGN PATENT DOCUMENTS

CN 103268757 A 8/2013
CN 106205461 A 12/2016

(Continued)

OTHER PUBLICATIONS

International Search Report and Written Opinion for Application No. PCT/CN2018/078958, dated Jun. 13, 2018, 12 Pages.

*Primary Examiner* — Gerald Johnson
(74) *Attorney, Agent, or Firm* — Brooks Kushman P.C.

(57) ABSTRACT

The present disclosure provides a gate driving unit, a driving method thereof, a gate driving circuit and a display device. The gate driving unit includes an input resetting module, a storage module, a pull-up node control module, a pull-down node control module and an output module. The gate driving unit further includes a clock signal control module, connected to a first control signal end, a second control signal end, a first reference clock signal end, a second reference clock signal end, a first clock signal end and a second clock signal end, and configured to, under the control of a first control signal from the first control signal end and a second (Continued)

control signal from the second control signal end, output clock signals at a same frequency and in opposite phases to the first clock signal end and the second clock signal end respectively in accordance with a first reference clock signal from the first reference clock signal end and a second reference clock signal from the second reference clock signal.

20 Claims, 4 Drawing Sheets

(52) U.S. Cl.
CPC . *G09G 2310/0267* (2013.01); *G09G 2310/06* (2013.01); *G09G 2310/08* (2013.01); *G09G 2330/023* (2013.01)

(58) Field of Classification Search
CPC ..... G09G 3/3655; G09G 2310/0272; G09G 2310/0278; G09G 2310/0264
See application file for complete search history.

(56) References Cited

U.S. PATENT DOCUMENTS

| | | | | |
|---|---|---|---|---|
| 2016/0049126 | A1* | 2/2016 | Zhang | G09G 3/3696 345/173 |
| 2016/0372063 | A1* | 12/2016 | Li | G09G 3/3677 |
| 2019/0005866 | A1 | 1/2019 | Li et al. | |
| 2019/0019442 | A1* | 1/2019 | Xu | G09G 3/3677 |
| 2019/0129547 | A1* | 5/2019 | Dai | G06F 3/0416 |
| 2019/0130858 | A1* | 5/2019 | Xiao | G09G 3/3677 |
| 2019/0130859 | A1* | 5/2019 | Dai | G11C 19/28 |
| 2019/0228830 | A1* | 7/2019 | Xu | G11C 19/28 |
| 2020/0226995 | A1* | 7/2020 | Dai | G02F 1/136286 |

FOREIGN PATENT DOCUMENTS

| | | | |
|---|---|---|---|
| CN | 106251804 | A | 12/2016 |
| CN | 106960652 | A | 7/2017 |

* cited by examiner

GATE DRIVING UNIT, DRIVING METHOD THEREOF, GATE DRIVING CIRCUIT AND DISPLAY DEVICE

CROSS-REFERENCE TO RELATED APPLICATION APPLICATIONS

This application is the U.S. national phase of PCT Application No. PCT/CN2018/078958 filed on Mar. 14, 2018, which claims priority to Chinese Patent Application No. 201710264805.0 filed on Apr. 21, 2017, which are incorporated herein by reference in their entireties.

TECHNICAL FIELD

The present disclosure relates to the field of display driving technology, in particular to a gate driving unit, a driving method thereof, a gate driving circuit and a display device.

BACKGROUND

For a conventional display panel in a normal display state, it is impossible to change its resolution at any time in accordance with different display requirements, to achieve a Smart View function and switch between a high definition display mode and a low power consumption mode randomly, i.e., it is impossible to effectively reduce the power consumption while meeting a visual requirement.

SUMMARY

In one aspect, the present disclosure provides in some embodiments a gate driving unit, including an input resetting module, a storage module, a pull-up node control module, a pull-down node control module and an output module. The input resetting module is connected to a pull-up node, the pull-up node control module is connected to a pull-down node and the pull-up node, and the storage module is connected to the pull-up node and a gate driving signal output end. The pull-down node control module is connected to a first clock signal end, the pull-up node and the pull-down node, and configured to control the pull-down node to be electrically connected to the first clock signal end when a potential at the pull-up node is a first level and a second level is applied to the first clock signal end. The output module is connected to the pull-up node, the pull-down node, a second clock signal end and the gate driving signal output end, and configured to control the gate driving signal output end to be electrically connected to the second clock signal end when the potential at the pull-up node is a second level. The gate driving unit further includes a clock signal control module connected to a first control signal end, a second control signal end, a first reference clock signal end, a second reference clock signal end, the first clock signal end and the second clock signal end, and configured to, under the control of a first control signal from the first control signal end and a second control signal from the second control signal end, output clock signals at a same frequency and in opposite phases to the first clock signal end and the second clock signal end at the same time respectively in accordance with a first reference clock signal from the first reference clock signal end and a second reference clock signal from the second reference clock signal end.

In accordance with some embodiments of the present disclosure, the first reference clock signal and the second reference clock signal are at a same frequency and in opposite phases.

In accordance with some embodiments of the present disclosure, the clock signal control module includes: a first switching transistor, a gate electrode of which is connected to the first control signal end, a first electrode of which is connected to the first reference clock signal end, and a second electrode of which is connected to the first clock signal end; a second switching transistor, a gate electrode of which is connected to the second control signal end, a first electrode of which is connected to the first clock signal end, and a second electrode of which is connected to the second reference clock signal end; a third switching transistor, a gate electrode of which is connected to the first control signal end, a first electrode of which is connected to the second reference clock signal end, and a second electrode of which is connected to the second clock signal end; and a fourth switching transistor, a gate electrode of which is connected to the second control signal end, a first electrode of which is connected to the second clock signal end, and a second electrode of which is connected to the first reference clock signal end.

In accordance with some embodiments of the present disclosure, the clock signal control module includes: a first switching transistor, a gate electrode of which is connected to the first control signal end, a first electrode of which is connected to the first reference clock signal end, and a second electrode of which is connected to the first clock signal end; a second switching transistor, a gate electrode of which is connected to the second control signal end, a first electrode of which is connected to the first clock signal end, and a second electrode of which is connected to the second reference clock signal end; and an inverter, an input end of which is connected to the first clock signal end, and an output end of which is connected to the second clock signal end.

In accordance with some embodiments of the present disclosure, the pull-down node control module is further connected to the gate driving signal output end and a first level input end, and further configured to control the pull-down node to be electrically connected to the first level input end when the potential at the pull-up node is the second level, and control the pull-down node to be electrically connected to the first level input end when the a gate driving signal from the gate driving signal output end is at the second level. The output module is further connected to the first level input end, and further configured to control the gate driving signal output end to be electrically connected to the first level input end when a potential at the pull-down node is the second level.

In accordance with some embodiments of the present disclosure, the pull-down node control module includes: a first pull-down node control transistor, a gate electrode of which is connected to the pull-up node, a first electrode of which is connected to the first level input end, and a second electrode of which is connected to the pull-down node; a second pull-down node control transistor, a gate electrode of which is connected to the gate driving signal output end, a first electrode of which is connected to the pull-down node, and a second electrode of which is connected to the first level input end; a third pull-down node control transistor, a gate electrode and a first electrode of which are connected to the first clock signal end, and a second electrode of which is connected to the pull-down node; and a pull-down node potential maintenance capacitor, a first end of which is connected to the pull-down node, and a second end of which is connected to the first level input end. The output module includes: a pull-up transistor, a gate electrode of which is connected to the pull-up node, a first electrode of which is connected to the second clock signal end, and a second electrode of which is connected to the gate driving signal output end; and a pull-down transistor, a gate electrode of which is connected to the pull-down node, a first electrode of which is connected to the gate driving signal output end, and a second electrode of which is connected to the first level input end.

In accordance with some embodiments of the present disclosure, the input resetting module includes: an inputting transistor, a gate electrode of which is connected to an input end, a first electrode of which is connected to a first scanning level input end, and a second electrode of which is connected to the pull-up node; and a resetting transistor, a gate electrode of which is connected to a resetting end, a first electrode of which is connected to the pull-up node, and a second electrode of which is connected to a second scanning level input end. The storage module includes a storage capacitor, a first end of which is connected to the pull-up node, and a second end of which is connected to the gate driving signal output end. The pull-up node control module includes a pull-up node control transistor, a gate electrode of which is connected to the pull-down node, a first electrode of which is connected to the pull-up node, and a second electrode of which is connected to the first level input end.

In another aspect, the present disclosure provides in some embodiments a method for driving the above-mentioned gate driving unit, including: at a low power consumption display stage, under the control of the first control signal and the second control signal, applying, by the clock signal control module, the first clock signal to the first clock signal input end and applying the second clock signal to the second clock signal input end in accordance with the first reference clock signal and the second reference clock signal, the first clock signal and the second clock signal being at a same frequency and in opposite phases, the first control signal and the second control signal being each a signal at a fixed level; and at a high definition display stage, under the control of the first control signal and the second control signal, applying, by the clock signal control module, a third clock signal to the first clock signal input end and applying a fourth clock signal to the second clock signal input end in accordance with the first reference clock signal and the second reference clock signal, the third clock signal and the fourth clock signal being at a same frequency and in opposite phases, the first control signal and the second control signal being at a same frequency, the first reference clock signal and the second reference clock signal being at a same frequency and in opposite phases, each of the first reference clock signal and the second reference clock signal having a period of T, the first control signal being delayed by T/4 relative to the first reference clock signal, and the third clock signal having a frequency greater than the first clock signal.

In yet another aspect, the present disclosure provides in some embodiments a gate driving circuit including a plurality of the above-mentioned gate driving units connected to each other in a cascaded manner.

In still yet another aspect, the present disclosure provides in some embodiments a display device including the above-mentioned gate driving circuit.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Figure 1:
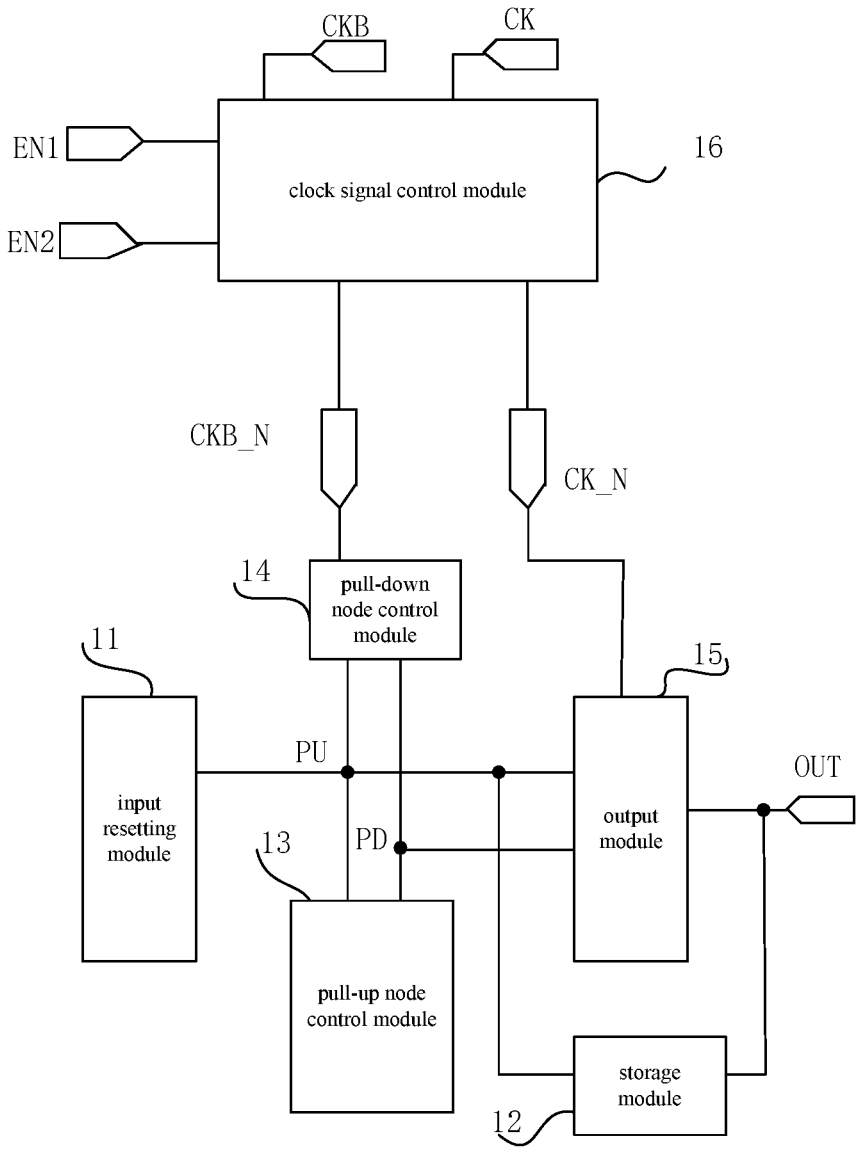
FIG. 1 is a schematic view showing a gate driving unit according to some embodiments of the present disclosure.

The present disclosure provides in some embodiments a gate driving unit which, as shown in FIG. 1, includes an input resetting module 11, a storage module 12, a pull-up node control module 13, a pull-down node control module 14 and an output module 15.

The input resetting module 11 is connected to a pull-up node PU, the pull-up node control module 13 is connected to a pull-down node PD and the pull-up node PU, and the storage module 12 is connected to the pull-up node PU and a gate driving signal output end OUT.

The pull-down node control module 14 is connected to a first clock signal end CKB_N, the pull-up node PU and the pull-down node PD, and configured to control the pull-down node PD to be electrically connected to the first clock signal end CKB_N when a potential at the pull-up node PU is a first level and a second level is applied to the first clock signal end CKB_N.

The output module 15 is connected to the pull-up node PU, the pull-down node PD, a second clock signal end CK_N and the gate driving signal output end OUT, and configured to control the gate driving signal output end OUT to be electrically connected to the second clock signal end CK_N when the potential at the pull-up node PU is a second level.

The gate driving unit further includes a clock signal control module 16 connected to a first control signal end EN1, a second control signal end EN2, a first reference clock signal end CKB, a second reference clock signal end CK, the first clock signal end CKB_N and the second clock signal end CK_N, and configured to, under the control of a first control signal from the first control signal end EN1 and a second control signal from the second control signal end EN2, output clock signals at a same frequency and in opposite phases to the first clock signal end CKB_N and the second clock signal end CK_N at the same time respectively in accordance with a first reference clock signal from the first reference clock signal end CKB and a second reference clock signal from the second reference clock signal end CK.

According to the gate driving unit in the embodiments of the present disclosure, the clock signal control module 16 is newly added, so as to, under the control of the first control signal and the second control signal, output the clock signals at the same frequency and in opposite phases to the first clock signal end CKB_N and the second clock signal end CK_N at the same time respectively in accordance with the first reference clock signal and the second reference clock signal, thereby to adjust the frequency of each of the clock signals applied to the first clock signal end CKB_N and the second clock signal end CK_N at any time and adjust the frequency of each clock signal at any time. As a result, it is able for a display panel to adjust a resolution at any time, achieve a Smart View function and switch between a high resolution display mode and a low power consumption mode randomly, thereby to effectively reduce the power consumption while meeting a visual requirement.

During the implementation, the first reference clock signal and the second reference clock signal are at a same frequency and in opposite phases.

In accordance with some embodiments of the present disclosure, the clock signal control module includes: a first switching transistor, a gate electrode of which is connected to the first control signal end, a first electrode of which is connected to the first reference clock signal end, and a second electrode of which is connected to the first clock signal end; a second switching transistor, a gate electrode of which is connected to the second control signal end, a first electrode of which is connected to the first clock signal end, and a second electrode of which is connected to the second reference clock signal end; a third switching transistor, a gate electrode of which is connected to the first control signal end, a first electrode of which is connected to the second reference clock signal end, and a second electrode of which is connected to the second clock signal end; and a fourth switching transistor, a gate electrode of which is connected to the second control signal end, a first electrode of which is connected to the second clock signal end, and a second electrode of which is connected to the first reference clock signal end.

Figure 2:
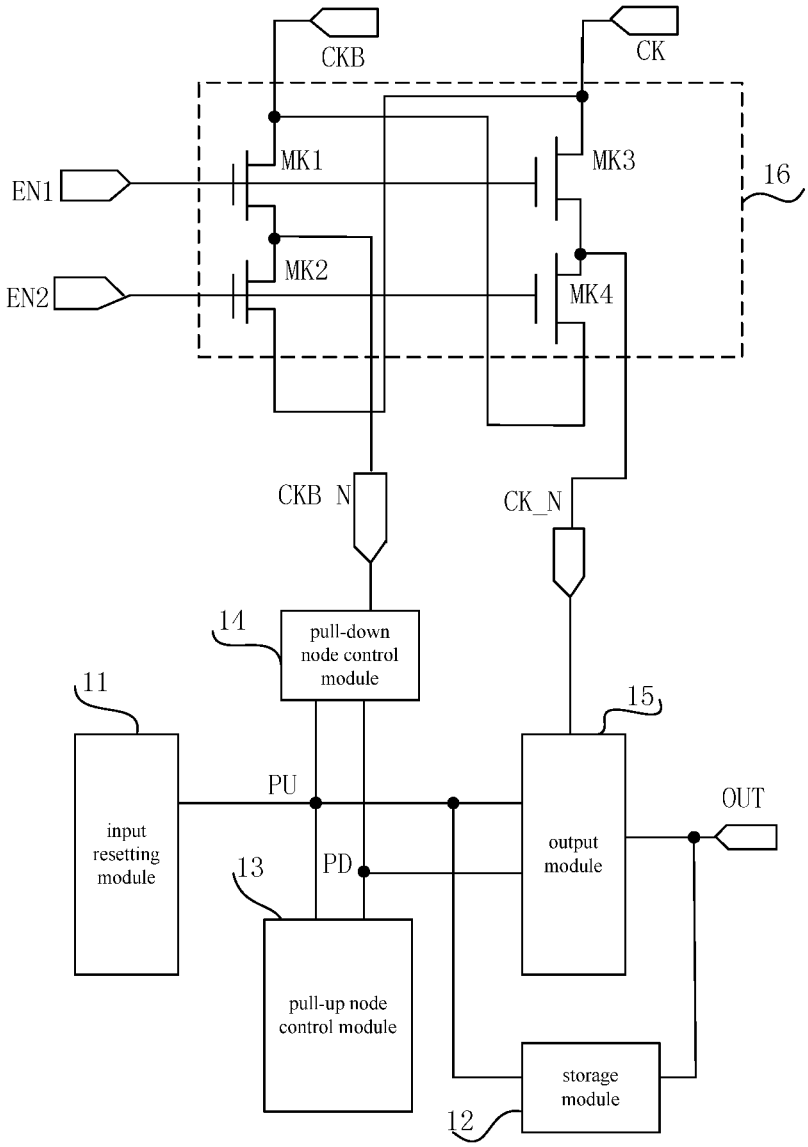
FIG. 2 is another schematic view showing the gate driving unit according to some embodiments of the present disclosure.

As shown in FIG. 2, on the basis of FIG. 1, the clock signal control module 16 includes: a first switching transistor MK1, a gate electrode of which is connected to the first control signal end EN1, a drain electrode of which is connected to the first reference clock signal end CKB, and a source electrode of which is connected to the first clock signal end CKB_N; a second switching transistor MK2, a gate electrode of which is connected to the second control signal end EN2, a drain electrode of which is connected to the first clock signal end CKB_N, and a source electrode of which is connected to the second reference clock signal end CK; a third switching transistor MK3, a gate electrode of which is connected to the first control signal end EN1, a drain electrode of which is connected to the second reference clock signal end CK, and a source electrode of which is connected to the second clock signal end CK_N; and a fourth switching transistor MK4, a gate electrode of which is connected to the second control signal end EN2, a drain electrode of which is connected to the second clock signal end CK_N, and a source electrode of which is connected to the first reference clock signal end CKB.

In FIG. 2, all the transistors may be N-type transistors. However, in actual use, all the transistors may also be P-type transistors, i.e., the types of the transistors will not be particularly defined herein.

The clock signals applied to CKB_N and CK_N are those desired for a display function of the gate driving unit.

Figure 3:
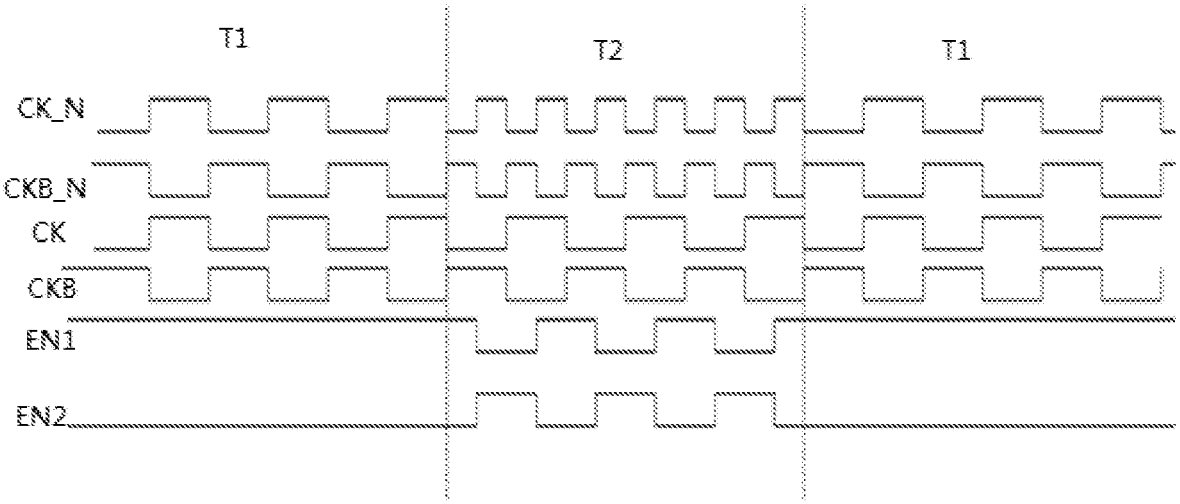
FIG. 3 is a sequence diagram of signals for the gate driving unit in FIG. 2.

As shown in FIG. 3, during the operation of the gate driving unit in FIG. 2, at a low power consumption display stage T1, EN1 outputs a high level, and EN2 outputs a low level. At this time, MK1 and MK3 are turned on, and MK2 and MK4 are turned off. CKB_N is electrically connected to CKB, and the clock signal applied to CKB_N is the first reference clock signal from CKB. In addition, CK is electrically connected to CK_N, and the clock signal applied to CK_N is the second reference clock signal from CK.

At a high definition display stage T2, the first control signal and the second control signal are both clock signals.

When EN1 outputs a high level and EN2 outputs a low level, MK1 is turned on, MK2 is turned off, MK3 is turned on, and MK4 is turned off. At this time, CKB_N is electrically connected to CKB, and CK_N is electrically connected to CK. When EN1 outputs a low level and EN2 outputs a high level, MK1 is turned off, MK2 is turned on, MK3 is turned off, and MK4 is turned on. At this time, CKB_N is electrically connected to CK, and CK_N is electrically connected to CKB.

When EN1 outputs a low level and EN2 outputs a high level, MK2 is turned on, MK1 is turned off, MK4 is turned on and MK3 is turned off. At this time, CKB_N is electrically connected to CK, and CK_N is electrically connected to CKB. When EN2 outputs a low level and EN1 outputs a high level, MK2 is turned off, MK1 is turned on, MK4 is turned off, and MK3 is turned on. At this time, CKB_N is electrically connected to CKB, and CK_N is electrically connected to CK.

Through configuring a waveform of the first control signal and a waveform of the second control signal at T2, it is able to adjust a frequency of the clock signal applied to each of CKB_N and CK_N to be twice of a frequency of the first reference clock signal, thereby to achieve a high definition display effect.

In actual use, the first reference clock signal and the second reference clock signal are at a same frequency and in opposite phases, and each of the first reference clock signal and the second reference clock signal has a period of T. At the high definition display stage T2, the waveform of the first control signal is delayed by T/4 relative to the first reference clock signal, and the waveform of the second control signal is in a phase opposite to the first control signal.

According to the gate driving unit in FIG. 2, the clock signal control module is provided, so as to control MK1, MK2, MK3 and MK4 through EN1 and EN2, thereby to output the clock signals at the same frequency and in opposite phases to CKB_N and CK_N respectively in accordance with the first reference clock signal from CKB and the second reference clock signal from CK. As shown in FIG. 3, through configuring the waveform of the first control signal and the waveform of the second control signal at different stages, it is able to increase the frequency of the clock signal applied to each of CKB_N and CK_N at the high definition display stage T2 to be twice of the frequency of the first reference clock signal, and reduce a charging time for each gate line by half, thereby to increase the resolution and achieve a high definition display function. At the low power consumption display stage T1, the frequency of the clock signal applied to each of CKB_N and CK_N is equal to the frequency of the first reference clock signal, so it is able to achieve a low power consumption function.

The waveform of the first control signal and the waveform of the second control signal may be adjusted through a display driving Integrated Circuit (IC).

In accordance with some embodiments of the present disclosure, the clock signal control module includes: a first switching transistor, a gate electrode of which is connected to the first control signal end, a first electrode of which is connected to the first reference clock signal end, and a second electrode of which is connected to the first clock signal end; a second switching transistor, a gate electrode of which is connected to the second control signal end, a first electrode of which is connected to the first clock signal end, and a second electrode of which is connected to the second reference clock signal end; and an inverter, an input end of which is connected to the first clock signal end, and an output end of which is connected to the second clock signal end. Through the inverter, it is able to ensure that the clock signal applied to the first clock signal end is in a phase opposite to the clock signal applied to the second clock signal end.

To be specific, the pull-down node control module is further connected to the gate driving signal output end and a first level input end, and further configured to control the pull-down node to be electrically connected to the first level input end when the potential at the pull-up node is the second level, and control the pull-down node to be electrically connected to the first level input end when the a gate driving signal from the gate driving signal output end is at the second level. The output module is further connected to the first level input end, and further configured to control the gate driving signal output end to be electrically connected to the first level input end when a potential at the pull-down node is the second level.

To be specific, the pull-down node control module may include: a first pull-down node control transistor, a gate electrode of which is connected to the pull-up node, a first electrode of which is connected to the first level input end, and a second electrode of which is connected to the pull-down node; a second pull-down node control transistor, a gate electrode of which is connected to the gate driving signal output end, a first electrode of which is connected to the pull-down node, and a second electrode of which is connected to the first level input end; a third pull-down node control transistor, a gate electrode and a first electrode of which are connected to the first clock signal end, and a second electrode of which is connected to the pull-down node; and a pull-down node potential maintenance capacitor, a first end of which is connected to the pull-down node, and a second end of which is connected to the first level input end. The output module may include: a pull-up transistor, a gate electrode of which is connected to the pull-up node, a first electrode of which is connected to the second clock signal end, and a second electrode of which is connected to the gate driving signal output end; and a pull-down transistor, a gate electrode of which is connected to the pull-down node, a first electrode of which is connected to the gate driving signal output end, and a second electrode of which is connected to the first level input end.

To be specific, the input resetting module may include: an inputting transistor, a gate electrode of which is connected to an input end, a first electrode of which is connected to a first scanning level input end, and a second electrode of which is connected to the pull-up node; and a resetting transistor, a gate electrode of which is connected to a resetting end, a first electrode of which is connected to the pull-up node, and a second electrode of which is connected to a second scanning level input end. The storage module may include a storage capacitor, a first end of which is connected to the pull-up node, and a second end of which is connected to the gate driving signal output end. The pull-up node control module may include a pull-up node control transistor, a gate electrode of which is connected to the pull-down node, a first electrode of which is connected to the pull-up node, and a second electrode of which is connected to the first level input end.

The gate driving unit will be described hereinafter in more details in conjunction with two embodiments.

Figure 4:
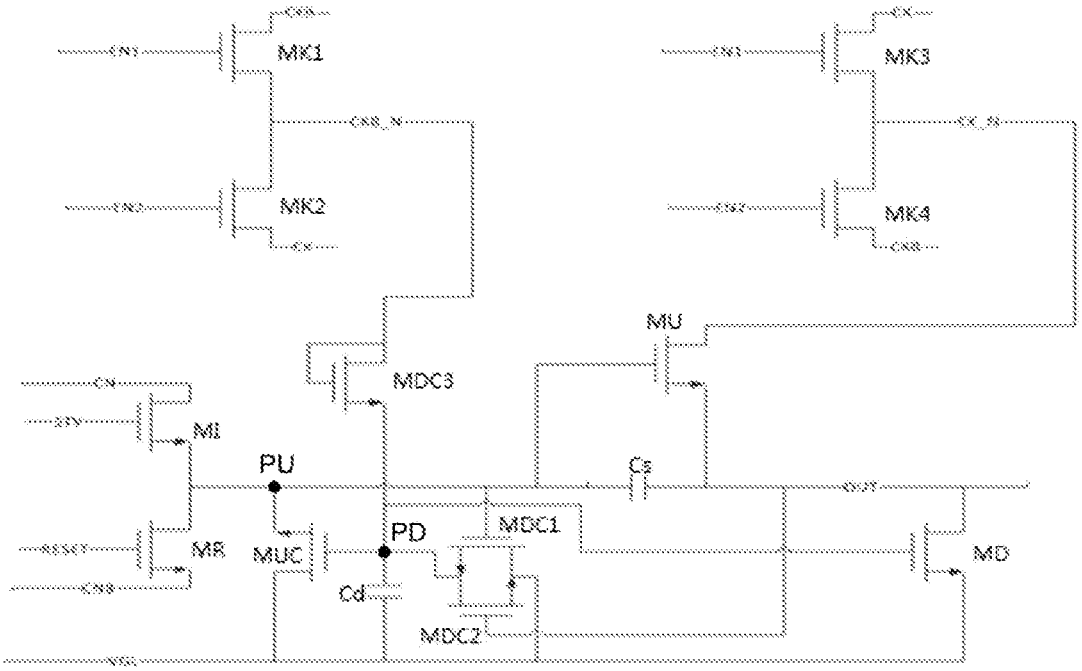
FIG. 4 is a circuit diagram of the gate driving unit according to a first embodiment of the present disclosure.

As shown in FIG. 4, in a first embodiment of the present disclosure, the gate driving unit includes the input resetting module, the storage module, the pull-up node control module, the pull-down node control module, the output module and the clock signal control module.

The clock signal control module includes: the first switching transistor MK1, a gate electrode of which is connected to the first control signal end EN1, a drain electrode of which is connected to the first reference clock signal end CKB, and a source electrode of which is connected to the first clock signal end CKB_N; the second switching transistor MK2, a gate electrode of which is connected to the second control signal end EN2, a drain electrode of which is connected to the first clock signal end CKB_N, and a source electrode of which is connected to the second reference clock signal end CK; the third switching transistor MK3, a gate electrode of which is connected to the first control signal end EN1, a drain electrode of which is connected to the second reference clock signal end CK, and a source electrode of which is connected to the second clock signal end CK_N; and the fourth switching transistor MK4, a gate electrode of which is connected to the second control signal end EN2, a drain electrode of which is connected to the second clock signal end CK_N, and a source electrode of which is connected to the first reference clock signal end CKB.

The pull-down node control module includes: a first pull-down node control transistor MDC1, a gate electrode of which is connected to the pull-up node PU, a drain electrode of which is connected to a low level input end to which a low level VGL is inputted, and a source electrode of which is connected to the pull-down node PD; a second pull-down node control transistor MDC2, a gate electrode of which is connected to the gate driving signal output end OUT, a drain electrode of which is connected to the pull-down node PD, and a source electrode of which is connected to the low level input end to which the low level VGL is inputted; a third pull-down node control transistor MDC3, a gate electrode and a drain electrode of which are connected to the first clock signal end CKB_N, and a source electrode of which is connected to the pull-down node PD; and a pull-down node potential maintenance capacitor Cd, a first end of which is connected to the pull-down node PD, and a second end of which is connected to the low level input end to which the low level VGL is inputted.

The output module includes: a pull-up transistor MU, a gate electrode of which is connected to the pull-up node PU, a drain electrode of which is connected to the second clock signal end CK_N, and a source electrode of which is connected to the gate driving signal output end OUT; and a pull-down transistor MD, a gate electrode of which is connected to the pull-down node PD, a gate electrode of which is connected to the gate driving signal output end OUT, and a source electrode of which is connected to the low level input end to which the low level VGL is inputted.

The input resetting module includes: an inputting transistor MI, a gate electrode of which is connected to an input end STV, a drain electrode of which is connected to a first scanning level input end CN, and a source electrode of which is connected to the pull-up node PU; and a resetting transistor MR, a gate electrode of which is connected to a resetting end RESET, a drain electrode of which is connected to the pull-up node PU, and a source electrode of which is connected to a second scanning level input end CNB.

The storage module includes a storage capacitor Cs, a first end of which is connected to the pull-up node PU, and a second end of which is connected to the gate driving signal output end OUT. The pull-up node control module includes a pull-up node control transistor MUC, a gate electrode of which is connected to the pull-down node PD, a drain electrode of which is connected to the pull-up node PU, and a source electrode of which is connected to the low level input end to which the low level VGL is inputted.

In the first embodiment of the present disclosure as shown in FIG. 4, CKB_N and CK_N are both clock signals desired for the display operation of the gate driving unit.

In the first embodiment of the present disclosure as shown in FIG. 4, all the transistors are N-type transistors. However, in actual use, the transistors may also be P-type transistors, and at this time, it is necessary to adjust a sequence of the control signals. The types of the transistors will not be particularly defined herein.

Figure 5:
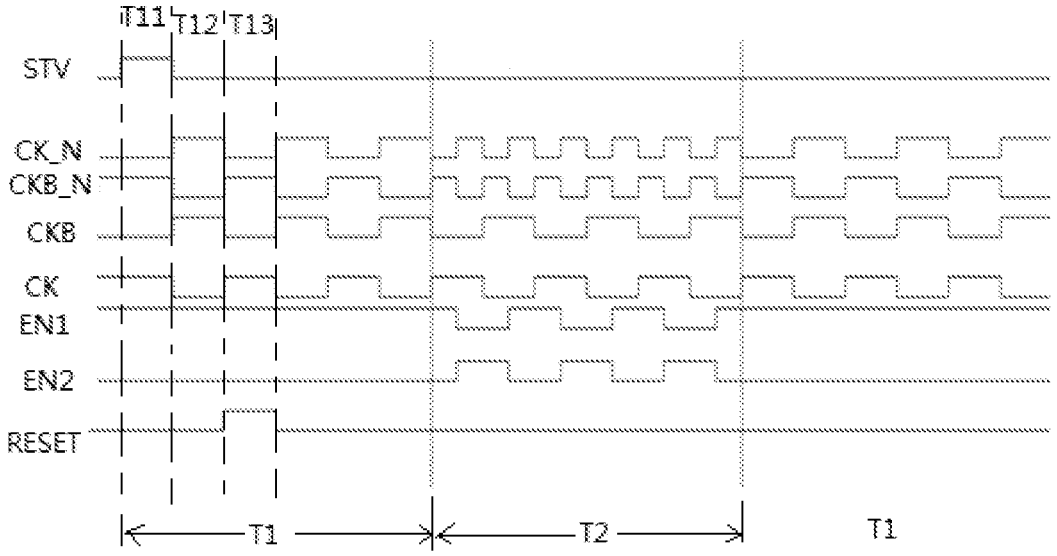
FIG. 5 is a sequence diagram of signals for the gate driving unit according to the first embodiment of the present disclosure.

As shown in FIG. 5, during the operation of the gate driving unit in the first embodiment of the present disclosure, CN outputs a high level and CNB outputs a low level.

At the low power consumption display stage T1, EN1 outputs a high level and EN2 outputs a low level, so CK_N is electrically connected to CK, and CKB_N is electrically connected to CKB.

Within a first input time period T11, MI is turned on due to an input signal from STV, and CN outputs a high level, so as to pull up the potential at PU, turn on MDC1, and pull down the potential at PD. At this time, the clock signal applied to CK_N is at a low level, so OUT outputs a low level.

Within a first output time period T12, the potential at PU is pulled up due to a bootstrapping effect of Cs. At this time, the clock signal applied to CK_N is at a high level, so as to turn on MU and fully pull up the potential of the gate driving signal from OUT to a high level, thereby to fully charge a gate line driven by the gate driving signal. Usually, a charging time of the gate line is equal to a duration within which the clock signal applied to CK_N is maintained at the high level. At this time, the display panel is in a low power consumption mode, so the charging time of the gate line is larger than that in a high definition display mode. MDC1 and MDC2 are both turned on, so as to pull down the potential at PD.

Within a first resetting time period T13, CK outputs a low level and CKB outputs a high level, so as to turn on MDC3. The potential at PD is pulled up to be a high level, so as to turn on MD and MUC. At this time, RESET outputs a high level, so as to directly pull down the potential at PU and the potential of the gate driving signal from OUT to the low level VGL, thereby to disenable the gate line in time.

At the high definition display stage T2, the display panel is in the high definition display mode, and the first control signal and the second control signal are both clock signals.

When EN1 outputs a high level and EN2 outputs a low level, MK1 is turned on, MK2 is turned off, MK3 is turned on and MK4 is turned off. At this time, CKB_N is electrically connected to CKB, and CK_N is electrically connected to CK. When EN1 outputs a low level and EN2 outputs a high level, MK1 is turned off, MK2 is turned on, MK3 is turned off and MK4 is turned on. At this time, CKB_N is electrically connected to CK, and CK_N is electrically connected to CKB.

When EN1 outputs a low level and EN2 outputs a high level, MK2 is turned on, MK1 is turned off, MK4 is turned on and MK3 is turned off. At this time, CKB_N is electrically connected to CK, and CK_N is electrically connected to CKB. When EN2 outputs a low level and EN1 outputs a high level, MK2 is turned off, MK1 is turned on, MK4 is turned off and MK3 is turned on. At this time, CKB_N is electrically connected to CKB, and CK_N is electrically connected to CK.

Through configuring the waveforms of the first control signal and the second control signal at T2, the frequency of the clock signal applied to each of CKB_N and CK_N may be twice of the frequency of the first reference clock signal. The charging time of the gate line is just a duration within which the clock signal applied to CK_N is maintained at a high level, so the charging time of the gate line in the high definition display mode may be a half of that in the low power consumption display mode, and twice as many gate lines may be charged or discharged within a same time period. As a result, it is able to achieve a high definition display effect.

Figure 6:
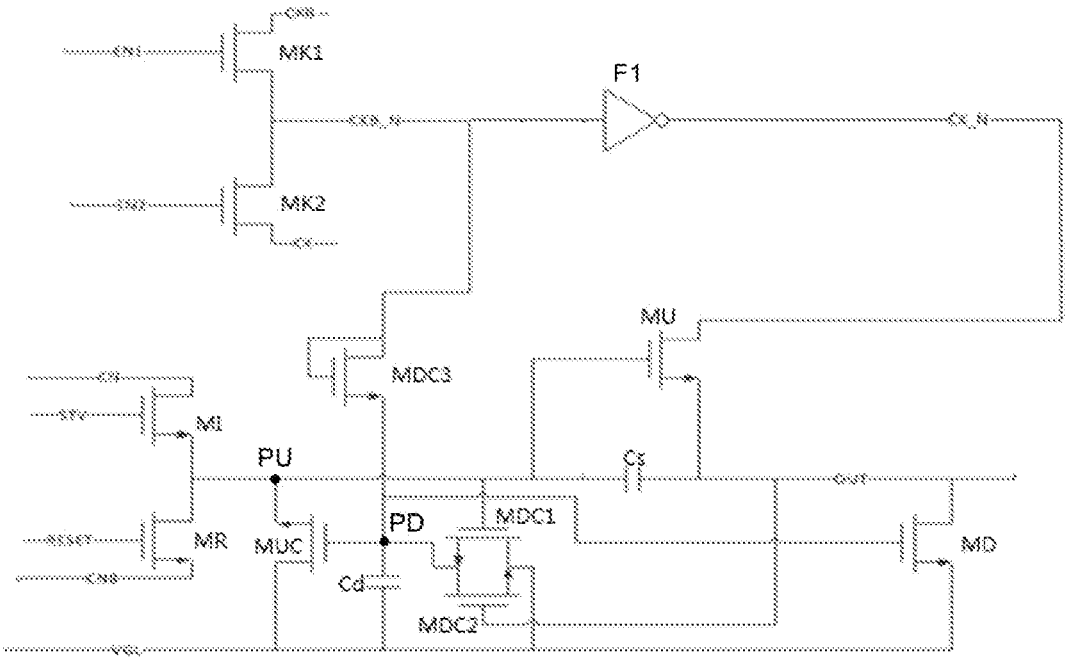
FIG. 6 is another circuit diagram of the gate driving unit according to a second embodiment of the present disclosure.

As shown in FIG. 6, in a second embodiment of the present disclosure, the gate driving unit includes the input resetting module, the storage module, the pull-up node control module, the pull-down node control module, the output module and the clock signal control module.

The clock signal control module includes: a first switching transistor MK1, a gate electrode of which is connected to the first control signal end EN1, a drain electrode of which is connected to the first reference clock signal end CKB, and a source electrode of which is connected to the first clock signal end CKB_N; a second switching transistor MK2, a gate electrode of which is connected to the second control signal end EN2, a drain electrode of which is connected to the first clock signal end CKB_N, and a source electrode of which is connected to the second reference clock signal end CK_N; and an inverter F1, an input end of which is connected to the first clock signal end CKB_N, and an output end of which is connected to the second clock signal end CK_N.

The pull-down node control module includes: a first pull-down node control transistor MDC1, a gate electrode of which is connected to the pull-up node PU, a drain electrode of which is connected to a low level input end to which a low level VGL is inputted, and a source electrode of which is connected to the pull-down node PD; a second pull-down node control transistor MDC2, a gate electrode of which is connected to the gate driving signal output end OUT, a drain electrode of which is connected to the pull-down node PD, and a source electrode of which is connected to the low level input end to which the low level VGL is inputted; a third pull-down node control transistor MDC3, a gate electrode and a drain electrode of which are connected to the first clock signal end CKB_N, and a source electrode of which is connected to the pull-down node PD; and a pull-down node potential maintenance capacitor Cd, a first end of which is connected to the pull-down node PD, and a second end of which is connected to the low level input end to which the low level VGL is inputted.

The output module includes: a pull-up transistor MU, a gate electrode of which is connected to the pull-up node PU, a drain electrode of which is connected to the second clock signal end CK_N, and a source electrode of which is connected to the gate driving signal output end OUT; and a pull-down transistor MD, a gate electrode of which is connected to the pull-down node PD, a gate electrode of which is connected to the gate driving signal output end OUT, and a source electrode of which is connected to the low level input end to which the low level VGL is inputted.

The input resetting module includes: an inputting transistor MI, a gate electrode of which is connected to an input end STV, a drain electrode of which is connected to a first scanning level input end CN, and a source electrode of which is connected to the pull-up node PU; and a resetting transistor MR, a gate electrode of which is connected to a resetting end RESET, a drain electrode of which is connected to the pull-up node PU, and a source electrode of which is connected to a second scanning level input end CNB.

The storage module includes a storage capacitor Cs, a first end of which is connected to the pull-up node PU, and a second end of which is connected to the gate driving signal output end OUT. The pull-up node control module includes a pull-up node control transistor MUC, a gate electrode of which is connected to the pull-down node PD, a drain electrode of which is connected to the pull-up node PU, and a source electrode of which is connected to the low level input end to which the low level VGL is inputted.

Apparently, the gate driving unit in FIG. 6 differs from that in FIG. 4 merely in that the third switching transistor MK3 and the fourth switching transistor MK4 are replaced with the inverter F1.

The present disclosure further provides in some embodiments a method for driving the above-mentioned gate driving unit, which includes: at a low power consumption display stage, under the control of the first control signal and the second control signal, applying, by the clock signal control module, the first clock signal to the first clock signal input end and applying the second clock signal to the second clock signal input end in accordance with the first reference clock signal and the second reference clock signal, the first clock signal and the second clock signal being at a same frequency and in opposite phases, the first control signal and the second control signal being each a signal at a fixed level; and at a high definition display stage, under the control of the first control signal and the second control signal, applying, by the clock signal control module, a third clock signal to the first clock signal input end and applying a fourth clock signal to the second clock signal input end in accordance with the first reference clock signal and the second reference clock signal.

The third clock signal and the fourth clock signal are at a same frequency and in opposite phases, and the first control signal and the second control signal are at a same frequency. It should be appreciated that, when the transistors of the gate driving unit are of a same type, e.g., N-type transistors or P-type transistors, the first control signal and the second control signal are at a same frequency and in opposite phases. The first reference clock signal and the second reference clock signal are at a same frequency and in opposite phases. Each of the first reference clock signal and the second reference clock signal has a period of T, the first control signal is delayed by T/4 relative to the first reference clock signal, and the third clock signal has a frequency greater than the first clock signal.

According to the method for driving the gate driving unit in the embodiments of the present disclosure, through the clock signal control module, the frequency of the clock signal applied to each of the first clock signal end and the second clock signal end at the high definition display stage is greater than that at the low power consumption display stage. As a result, it is able to achieve a Smart view function, and switch the display panel between a high definition display mode and a low power consumption mode, thereby to effectively reduce the power consumption while meeting a visual requirement.

The present disclosure further provides in some embodiments a gate driving circuit, which includes a plurality of gate driving units connected to each other in a cascaded manner.

The present disclosure further provides in some embodiments a display device including the above-mentioned gate driving circuit.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A gate driving unit, comprising an input resetting module, a storage module, a pull-up node control module, a pull-down node control module and an output module, wherein the input resetting module is connected to a pull-up node, the pull-up node control module is connected to a pull-down node and the pull-up node, and the storage module is connected to the pull-up node and a gate driving signal output end;

the pull-down node control module is connected to a first clock signal end, the pull-up node and the pull-down node, and configured to control the pull-down node to be electrically connected to the first clock signal end when a potential at the pull-up node is a first level and a second level is applied to the first clock signal end;

the output module is connected to the pull-up node, the pull-down node, a second clock signal end and the gate driving signal output end, and configured to control the gate driving signal output end to be electrically connected to the second clock signal end when the potential at the pull-up node is a second level; and the gate driving unit further comprises a clock signal control module connected to a first control signal end, a second control signal end, a first reference clock signal end, a second reference clock signal end, the first clock signal end and the second clock signal end, and configured to, under the control of a first control signal from the first control signal end and a second control signal from the second control signal end, output clock signals at a same frequency and in opposite phases to the first clock signal end and the second clock signal end at the same time respectively in accordance with a first reference clock signal from the first reference clock signal end and a second reference clock signal from the second reference clock signal end.

2. The gate driving unit according to claim 1, wherein the first reference clock signal and the second reference clock signal are at a same frequency and in opposite phases.

3. The gate driving unit according to claim 1, wherein the clock signal control module comprises:

a first switching transistor, a gate electrode of which is connected to the first control signal end, a first electrode of which is connected to the first reference clock signal end, and a second electrode of which is connected to the first clock signal end;

a second switching transistor, a gate electrode of which is connected to the second control signal end, a first electrode of which is connected to the first clock signal end, and a second electrode of which is connected to the second reference clock signal end;

a third switching transistor, a gate electrode of which is connected to the first control signal end, a first electrode of which is connected to the second reference clock signal end, and a second electrode of which is connected to the second clock signal end; and a fourth switching transistor, a gate electrode of which is connected to the second control signal end, a first electrode of which is connected to the second clock signal end, and a second electrode of which is connected to the first reference clock signal end.

4. The gate driving unit according to claim 1, wherein the clock signal control module comprises:

a first switching transistor, a gate electrode of which is connected to the first control signal end, a first electrode of which is connected to the first reference clock signal end, and a second electrode of which is connected to the first clock signal end;

a second switching transistor, a gate electrode of which is connected to the second control signal end, a first electrode of which is connected to the first clock signal end, and a second electrode of which is connected to the second reference clock signal end; and an inverter, an input end of which is connected to the first clock signal end, and an output end of which is connected to the second clock signal end.

5. The gate driving unit according to claim 1, wherein the pull-down node control module is further connected to the gate driving signal output end and a first level input end, and further configured to control the pull-down node to be electrically connected to the first level input end when the potential at the pull-up node is the second level, and control the pull-down node to be electrically connected to the first level input end when the a gate driving signal from the gate driving signal output end is at the second level; and the output module is further connected to the first level input end, and further configured to control the gate driving signal output end to be electrically connected to the first level input end when a potential at the pull-down node is the second level.

6. The gate driving unit according to claim 5, wherein the pull-down node control module comprises:

a first pull-down node control transistor, a gate electrode of which is connected to the pull-up node, a first electrode of which is connected to the first level input end, and a second electrode of which is connected to the pull-down node;

a second pull-down node control transistor, a gate electrode of which is connected to the gate driving signal output end, a first electrode of which is connected to the pull-down node, and a second electrode of which is connected to the first level input end;

a third pull-down node control transistor, a gate electrode and a first electrode of which are connected to the first clock signal end, and a second electrode of which is connected to the pull-down node; and a pull-down node potential maintenance capacitor, a first end of which is connected to the pull-down node, and a second end of which is connected to the first level input end.

7. The gate driving unit according to claim 5, wherein the output module comprises:

a pull-up transistor, a gate electrode of which is connected to the pull-up node, a first electrode of which is connected to the second clock signal end, and a second electrode of which is connected to the gate driving signal output end; and a pull-down transistor, a gate electrode of which is connected to the pull-down node, a first electrode of which is connected to the gate driving signal output end, and a second electrode of which is connected to the first level input end.

8. The gate driving unit according to claim 1, wherein the input resetting module comprises:

an inputting transistor, a gate electrode of which is connected to an input end, a first electrode of which is connected to a first scanning level input end, and a second electrode of which is connected to the pull-up node; and a resetting transistor, a gate electrode of which is connected to a resetting end, a first electrode of which is connected to the pull-up node, and a second electrode of which is connected to a second scanning level input end.

9. The gate driving unit according to claim 1, wherein the storage module comprises a storage capacitor, a first end of which is connected to the pull-up node, and a second end of which is connected to the gate driving signal output end.

10. The gate driving unit according to claim 1, wherein the pull-up node control module comprises a pull-up node control transistor, a gate electrode of which is connected to the pull-down node, a first electrode of which is connected to the pull-up node, and a second electrode of which is connected to the first level input end.

11. A method for driving the gate driving unit according to claim 1, comprising:

at a low power consumption display stage, under the control of the first control signal and the second control signal, applying, by the clock signal control module, the first clock signal to the first clock signal input end and applying the second clock signal to the second clock signal input end in accordance with the first reference clock signal and the second reference clock signal, the first clock signal and the second clock signal being at a same frequency and in opposite phases, the first control signal and the second control signal being each a signal at a fixed level; and at a high definition display stage, under the control of the first control signal and the second control signal, applying, by the clock signal control module, a third clock signal to the first clock signal input end and applying a fourth clock signal to the second clock signal input end in accordance with the first reference clock signal and the second reference clock signal, the third clock signal and the fourth clock signal being at a same frequency and in opposite phases, the first control signal and the second control signal being at a same frequency, the first reference clock signal and the second reference clock signal being at a same frequency and in opposite phases, each of the first reference clock signal and the second reference clock signal having a period of T, the first control signal being delayed by T/4 relative to the first reference clock signal, and the third clock signal having a frequency greater than the first clock signal.

12. A gate driving circuit, comprising a plurality of gate driving units, wherein the gate driving units are connected to each other in a cascaded manner, each of the gate driving units comprising an input resetting module, a storage module, a pull-up node control module, a pull-down node control module and an output module, wherein the input resetting module is connected to a pull-up node, the pull-up node control module is connected to a pull-down node and the pull-up node, and the storage module is connected to the pull-up node and a gate driving signal output end;

the pull-down node control module is connected to a first clock signal end, the pull-up node and the pull-down node, and configured to control the pull-down node to be electrically connected to the first clock signal end when a potential at the pull-up node is a first level and a second level is applied to the first clock signal end;

the output module is connected to the pull-up node, the pull-down node, a second clock signal end and the gate driving signal output end, and configured to control the gate driving signal output end to be electrically connected to the second clock signal end when the potential at the pull-up node is a second level; and the gate driving unit further comprises a clock signal control module connected to a first control signal end, a second control signal end, a first reference clock signal end, a second reference clock signal end, the first clock signal end and the second clock signal end, and configured to, under the control of a first control signal from the first control signal end and a second control signal from the second control signal end, output clock signals at a same frequency and in opposite phases to the first clock signal end and the second clock signal end at the same time respectively in accordance with a first reference clock signal from the first reference clock signal end and a second reference clock signal from the second reference clock signal end.

13. A display device, comprising the gate driving circuit according to claim 12.

14. The gate driving circuit according to claim 12, wherein the first reference clock signal and the second reference clock signal are at a same frequency and in opposite phases.

15. The gate driving circuit according to claim 12, wherein the clock signal control module comprises:

a first switching transistor, a gate electrode of which is connected to the first control signal end, a first electrode of which is connected to the first reference clock signal end, and a second electrode of which is connected to the first clock signal end;

a second switching transistor, a gate electrode of which is connected to the second control signal end, a first electrode of which is connected to the first clock signal end, and a second electrode of which is connected to the second reference clock signal end;

a third switching transistor, a gate electrode of which is connected to the first control signal end, a first electrode of which is connected to the second reference clock signal end, and a second electrode of which is connected to the second clock signal end; and a fourth switching transistor, a gate electrode of which is connected to the second control signal end, a first electrode of which is connected to the second clock signal end, and a second electrode of which is connected to the first reference clock signal end.

16. The gate driving circuit according to claim 12, wherein the clock signal control module comprises:

a first switching transistor, a gate electrode of which is connected to the first control signal end, a first electrode of which is connected to the first reference clock signal end, and a second electrode of which is connected to the first clock signal end;

a second switching transistor, a gate electrode of which is connected to the second control signal end, a first electrode of which is connected to the first clock signal end, and a second electrode of which is connected to the second reference clock signal end; and an inverter, an input end of which is connected to the first clock signal end, and an output end of which is connected to the second clock signal end.

17. The gate driving circuit according to claim 12, wherein the pull-down node control module is further connected to the gate driving signal output end and a first level input end, and further configured to control the pull-down node to be electrically connected to the first level input end when the potential at the pull-up node is the second level, and control the pull-down node to be electrically connected to the first level input end when the a gate driving signal from the gate driving signal output end is at the second level; and the output module is further connected to the first level input end, and further configured to control the gate driving signal output end to be electrically connected to the first level input end when a potential at the pull-down node is the second level.

18. The gate driving circuit according to claim 17, wherein the pull-down node control module comprises:

a first pull-down node control transistor, a gate electrode of which is connected to the pull-up node, a first electrode of which is connected to the first level input end, and a second electrode of which is connected to the pull-down node;

a second pull-down node control transistor, a gate electrode of which is connected to the gate driving signal output end, a first electrode of which is connected to the pull-down node, and a second electrode of which is connected to the first level input end;

a third pull-down node control transistor, a gate electrode and a first electrode of which are connected to the first clock signal end, and a second electrode of which is connected to the pull-down node; and a pull-down node potential maintenance capacitor, a first end of which is connected to the pull-down node, and a second end of which is connected to the first level input end.

19. The gate driving circuit according to claim 17, wherein the output module comprises:

a pull-up transistor, a gate electrode of which is connected to the pull-up node, a first electrode of which is connected to the second clock signal end, and a second electrode of which is connected to the gate driving signal output end; and a pull-down transistor, a gate electrode of which is connected to the pull-down node, a first electrode of which is connected to the gate driving signal output end, and a second electrode of which is connected to the first level input end.

20. The gate driving circuit according to claim 12, wherein the input resetting module comprises:

an inputting transistor, a gate electrode of which is connected to an input end, a first electrode of which is connected to a first scanning level input end, and a second electrode of which is connected to the pull-up node; and a resetting transistor, a gate electrode of which is connected to a resetting end, a first electrode of which is connected to the pull-up node, and a second electrode of which is connected to a second scanning level input end, wherein the storage module comprises a storage capacitor, a first end of which is connected to the pull-up node, and a second end of which is connected to the gate driving signal output end, wherein the pull-up node control module comprises a pull-up node control transistor, a gate electrode of which is connected to the pull-down node, a first electrode of which is connected to the pull-up node, and a second electrode of which is connected to the first level input end.

* * * * *